US010765904B1

(12) United States Patent
Pasterino et al.

(10) Patent No.: US 10,765,904 B1
(45) Date of Patent: Sep. 8, 2020

(54) EXERCISE DEVICE

(71) Applicant: Pvolve, LLC, New York, NY (US)

(72) Inventors: Stephen Pasterino, New York, NY (US); Stephanie Wineman, New York, NY (US)

(73) Assignee: Pvolve, LLC, New York, NY (US)

( * ) Notice: Subject to any disclaimer, the term of this patent is extended or adjusted under 35 U.S.C. 154(b) by 0 days.

(21) Appl. No.: 16/299,997

(22) Filed: Mar. 12, 2019

(51) Int. Cl.
*A63B 21/04* (2006.01)
*A63B 21/055* (2006.01)
(Continued)

(52) U.S. Cl.
CPC .... *A63B 21/0435* (2013.01); *A63B 21/00043* (2013.01); *A63B 21/00061* (2013.01);
(Continued)

(58) Field of Classification Search
CPC ..... A63B 5/00; A63B 5/22; A63B 21/0004; A63B 21/00043; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/0601; A63B 21/0604; A63B 21/0607; A63B 21/0608; A63B 21/065;
(Continued)

(56) References Cited

U.S. PATENT DOCUMENTS 1,506,631 A * 8/1924 Grover ..... A63B 21/0004 482/124
1,611,076 A * 12/1926 Rittner ..... A63B 69/0086 473/147
(Continued)

FOREIGN PATENT DOCUMENTS

GB 2280613 A * 2/1995 ..... A63B 43/007
GB 2507581 A * 5/2014 ..... A63B 69/0079

OTHER PUBLICATIONS

International Search Report and Written Opinion for International Application No. PCT/US2020/021816, dated Apr. 9, 2020, 16 pages.

*Primary Examiner* — Gary D Urbiel Goldner
(74) *Attorney, Agent, or Firm* — Foley & Lardner LLP

(57) ABSTRACT

An exercise device includes a strap. The strap includes a first surface and a second surface opposite the first surface. The strap is configured to be secured to a lower leg of a user such that the first surface of the strap interfaces with the lower leg of the user. The exercise device further includes a ball including an outer surface configured to be held by the user, a first connector extending from the ball, a second connector extending from the second surface of the strap, and a tension member. The tension member includes a first coupling mechanism and a second coupling mechanism at opposite ends thereof and configured to be releasably coupled to the first connector and the second connector via the first and second coupling mechanisms.

20 Claims, 8 Drawing Sheets

(51) Int. Cl.

| | |
|---|---|
| ***A63B 21/00*** | (2006.01) |
| ***A63B 21/06*** | (2006.01) |
| ***A63B 21/08*** | (2006.01) |
| ***A63B 23/035*** | (2006.01) |

(52) U.S. Cl.

CPC .... *A63B 21/00185* (2013.01); *A63B 21/0557* (2013.01); *A63B 21/0607* (2013.01); *A63B 21/08* (2013.01); *A63B 21/4013* (2015.10); *A63B 21/4015* (2015.10); *A63B 21/4035* (2015.10); *A63B 21/4043* (2015.10); *A63B 23/03575* (2013.01); *A63B 2208/0204* (2013.01); *A63B 2208/0257* (2013.01); *A63B 2208/0266* (2013.01); *A63B 2209/00* (2013.01); *A63B 2209/10* (2013.01); *A63B 2225/09* (2013.01)

(58) Field of Classification Search

CPC ..... A63B 21/068; A63B 21/08; A63B 21/15; A63B 21/151; A63B 21/16; A63B 21/4001; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4034; A63B 21/4035; A63B 21/4041; A63B 21/4043; A63B 23/035; A63B 23/03508; A63B 23/03516; A63B 23/03533; A63B 23/03541; A63B 23/0355; A63B 23/03575; A63B 2023/006; A63B 37/00; A63B 37/02; A63B 37/04; A63B 37/12; A63B 37/14; A63B 43/00; A63B 43/007; A63B 69/0057; A63B 69/0059; A63B 69/0073; A63B 69/0079; A63B 69/0084; A63B 69/0086; A63B 69/0088; A63B 69/20; A63B 69/203; A63B 69/24; A63B 69/26; A63B 2069/0062; A63B 2069/0082; A63B 2208/0204; A63B 2208/0209; A63B 2208/0214; A63B 2208/0228; A63B 2208/0233; A63B 2208/0238; A63B 2208/0242; A63B 2208/0247; A63B 2208/0252; A63B 2208/0257; A63B 2208/0266; A63B 2209/00; A63B 2209/10; A63B 2225/09

See application file for complete search history.

(56) References Cited

U.S. PATENT DOCUMENTS 2,051,366 A * 8/1936 Catron ..... A63B 23/025 273/DIG. 17
3,042,404 A * 7/1962 Masters ..... A63B 69/0086 473/424
3,410,554 A * 11/1968 Harrison ..... A63B 21/00192 273/453
3,528,654 A * 9/1970 Larson ..... A63B 5/22 446/26
4,071,241 A * 1/1978 Cortes Garcia ..... A63B 43/02 273/DIG. 19
4,121,822 A * 10/1978 DiSabatino ..... A63B 69/0086 2/310
4,121,829 A * 10/1978 Petrusek ..... A63B 69/0086 473/576
4,247,117 A * 1/1981 Reichert ..... A63B 69/0086 473/424
4,333,658 A * 6/1982 Giovetti ..... A63B 69/0086 273/DIG. 17
4,350,338 A * 9/1982 May ..... A63B 69/0079 473/423
4,687,209 A * 8/1987 Carey ..... A63B 69/0086 273/DIG. 19
5,054,786 A * 10/1991 Solomon ..... A63B 69/0079 473/147
5,181,726 A * 1/1993 Piaget ..... A63B 21/0603 273/330
5,238,241 A * 8/1993 Christensen ..... A63B 69/0088 473/424
5,250,016 A * 10/1993 Higgins ..... A63B 21/0552 482/121
5,358,258 A * 10/1994 Killion ..... A63B 69/002 273/DIG. 19
5,443,576 A * 8/1995 Hauter ..... A63B 69/0086 273/DIG. 19
5,611,540 A * 3/1997 Williams ..... A63B 43/007 473/429
5,669,837 A * 9/1997 Hauter ..... A63B 69/0086 273/DIG. 19
5,772,542 A * 6/1998 Gildea ..... A63B 43/007 473/576
5,853,339 A * 12/1998 Scerbo ..... A63B 69/0086 473/576
5,916,046 A * 6/1999 Allred ..... A63B 69/0079 473/430
5,976,041 A * 11/1999 Banker, Sr. ..... A63B 43/007 473/424
6,152,838 A * 11/2000 Killion ..... A63B 43/007 273/331
6,302,814 B1 * 10/2001 Cade ..... A63B 67/10 473/576
6,514,161 B1 * 2/2003 Minniear ..... A63B 69/0002 473/423
6,716,119 B1 * 4/2004 Weisz ..... A63B 69/0084 473/423
6,776,679 B1 8/2004 Menow
8,771,106 B1 * 7/2014 Boulanger ..... A63B 43/007 473/422
8,926,331 B1 * 1/2015 Schlapik ..... A63B 67/08 434/219
2002/0173216 A1 * 11/2002 Abel ..... A63B 69/0086 446/26
2004/0009833 A1 * 1/2004 Selevan ..... A63B 69/0086 473/576
2004/0110611 A1 * 6/2004 Huang ..... A63B 21/0552 482/126
2004/0192156 A1 * 9/2004 Abel ..... A63B 69/0079 446/26
2004/0204299 A1 * 10/2004 Shirley ..... A63B 24/0021 482/81
2006/0111205 A1 * 5/2006 Abel ..... A63B 43/007 473/508
2006/0183570 A1 * 8/2006 Gamsaragan ..... A63B 69/0086 473/424
2007/0142136 A1 * 6/2007 Anthony Miles .. A63B 69/0086 473/576
2007/0155544 A1 * 7/2007 Killion ..... A63B 69/0086 473/424
2007/0215063 A1 * 9/2007 Simpson ..... A01K 15/025 119/708
2008/0200289 A1 * 8/2008 Abel ..... A63B 43/007 473/576
2009/0075763 A1 * 3/2009 Wu ..... A63B 69/0086 473/424
2009/0197711 A1 * 8/2009 Sommers ..... A63B 69/00 473/508
2010/0075784 A1 * 3/2010 Maina ..... A63B 43/007 473/424
2011/0136596 A1 * 6/2011 Rasmussen ..... A63B 69/0086 473/459
2012/0225754 A1 * 9/2012 Kirtchakov ..... A63B 69/26 482/88
2012/0258844 A1 * 10/2012 Petrone ..... A63B 23/04 482/124

(56) References Cited

U.S. PATENT DOCUMENTS

| | | | | |
|---|---|---|---|---|
| 2013/0072326 | A1* | 3/2013 | Pugliese | A63B 69/0079 473/425 |
| 2013/0085045 | A1* | 4/2013 | Chavez | A63B 21/0442 482/93 |
| 2014/0287852 | A1* | 9/2014 | Clark | A63B 69/0002 473/424 |
| 2014/0315666 | A1* | 10/2014 | Medley | A63B 69/0059 473/450 |
| 2015/0209613 | A1* | 7/2015 | Payan | A63B 23/16 482/49 |
| 2015/0251070 | A1* | 9/2015 | Castillo, Jr. | A63B 69/0091 473/424 |
| 2016/0151693 | A1* | 6/2016 | Keith | A63B 69/00 473/424 |
| 2016/0199717 | A1* | 7/2016 | Holland | A63B 69/0079 473/423 |
| 2016/0310815 | A1* | 10/2016 | Anderson | A63B 69/0086 |
| 2016/0345656 | A1* | 12/2016 | Ramirez, II | A43B 5/18 |
| 2016/0375336 | A1* | 12/2016 | Matute Salgado | C09J 5/00 473/425 |
| 2017/0239507 | A1* | 8/2017 | Haas | A63B 21/0552 |
| 2017/0258661 | A1* | 9/2017 | Bradford | A61H 1/008 |
| 2018/0178049 | A1* | 6/2018 | Marquez | A63B 21/0442 |
| 2018/0207505 | A1* | 7/2018 | Briscoe | A63B 69/0071 |
| 2019/0116759 | A1* | 4/2019 | Petitt | A01K 15/025 |

* cited by examiner

EXERCISE DEVICE

BACKGROUND

The present disclosure relates generally to exercise devices for exercising the upper and lower body of a user. More specifically, the present disclosure relates to an exercise device in which a user can add and adjust resistance in training different sets of upper and lower body muscles. This type of training may allow the user to strengthen and/or tone both upper and lower body muscle groups through the use of said exercise device.

Traditional exercise equipment is typically intended to target a specific muscle group and may also require auxiliary equipment in order to complete various exercises. Traditional exercise equipment may also present various challenges and dangers to users that, in some instances, may depend on strength and experience of the user. For example, a user performing exercises with free weights such as dumbbells may require additional equipment such as a bench, as well as dumbbells of various weights in order to adjust resistance. Further to the previous example, a user training with free weights may not be familiar with proper weight training techniques and safety practices that may put the user at risk of serious injury in the instance that improper technique and/or weights are user for one or more exercises.

Traditional exercise equipment may also be intended for use in a specific range of motion or performing a specific exercise. As such, a user intending to engage in training one or more muscle groups using multiple exercises and/or ranges of motion faces the challenge of using multiple different pieces of exercise equipment alternatively. In some instances, a user may implement a training technique intended to minimize rest time between exercises, which presents a challenge when multiple pieces of exercise equipment are required and may require set-up or other assistance prior to use, thus interrupting such a training technique.

SUMMARY

One embodiment relates to an exercise device. The exercise device includes a strap. The strap includes a first surface and a second surface opposite the first surface. The strap is configured to be secured to a lower leg of a user such that the first surface of the strap interfaces with the lower leg of the user. The exercise device further includes a ball including an outer surface configured to be held by the user, a first connector extending from the ball, a second connector extending from the second surface of the strap, and a tension member. The tension member includes a first coupling mechanism and a second coupling mechanism at opposite ends thereof and configured to be releasably coupled to the first connector and the second connector via the first and second coupling mechanisms.

Another embodiment relates to an exercise device. The exercise device includes a ball including an outer surface configured to be held by a user, a first connector extending from the ball, and a first strap configured to be secured to a lower leg of the user. The first strap includes a first surface configured to interface with the lower leg of the user, a second surface opposite the first surface, and a second connector extending from the second surface. The exercise device also includes a second strap configured to be secured to a lower leg of the user. The second strap includes a third surface configured to interface with the lower leg of the user, a fourth surface opposite the third surface, and a third connector extending from the fourth surface. The exercise device further includes a first tension member including a first coupling mechanism and a second coupling mechanism at opposite ends thereof and a second tension member including a third coupling mechanism and a fourth coupling mechanism at opposite ends thereof. Each of the first tension member and the second tension member is configured to be releasably coupled to the first connector of the ball and to at least one of the second connector of the first strap or the third connector of the second strap, via the first and second coupling mechanisms of the first tension member and the third and fourth coupling mechanisms of the second tension member, such that the exercise device is configured to be used with the ball coupled to at least one of the first tension member or the second member.

Another embodiment relates to an exercise device. The exercise device includes a strap. The strap includes a first surface and a second surface opposite the first surface. The strap is configured to be secured to a lower leg of a user such that the first surface of the strap interfaces with the lower leg of the user. The exercise device further includes a ball including an outer surface configured to be held by the user, a first connector extending from the ball, a second connector extending from the second surface of the strap, and a tension member. The tension member includes a first coupling mechanism and a second coupling mechanism at opposite ends thereof and configured to be releasably coupled to the first connector and the second connector via the first and second coupling mechanisms. The exercise device also includes at least one tension member extension. Each tension member extension is configured to be releasably coupled between the tension member and at least one of the first connector or the second connector.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, an exercise device is shown according to exemplary embodiments. The exercise device can be used by a user to exercise both upper and lower body muscles of the user through resistance training. The exercise device includes a ball and a strap coupled together by a tension member, which advantageously enables the user to retain freedom to perform various resisted exercise movements through multiple ranges of motion. The user may attach the strap to a lower leg (e.g., a lower portion of the calf, the ankle region, the foot) of the user and hold the ball such that the tension member provides variable resistance through a wide range of motion so as to accommodate various exercises and movement patterns.

Figure 1A:
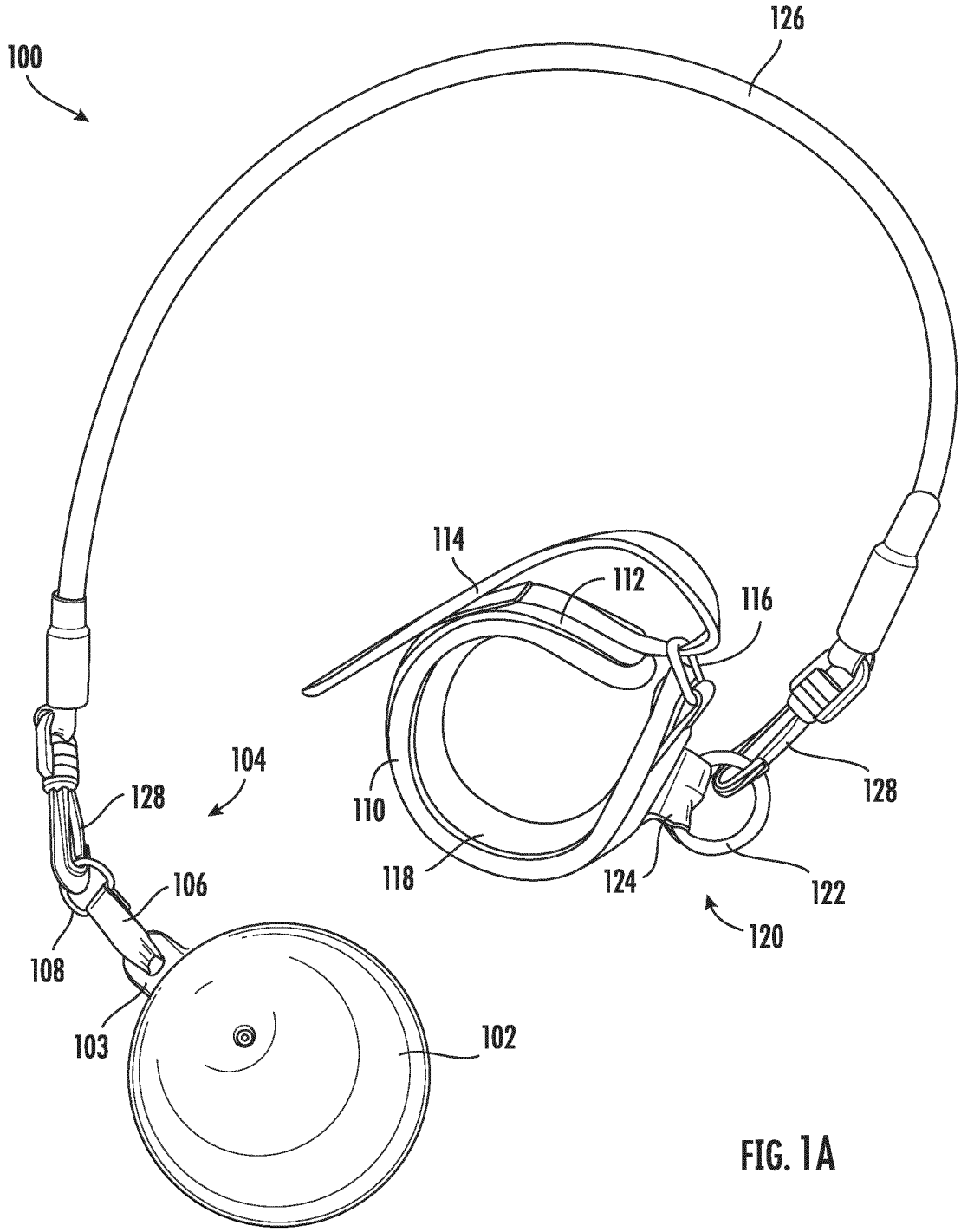
FIG. 1A is an illustration of an exercise device, according to an exemplary embodiment.
Figure 1B:
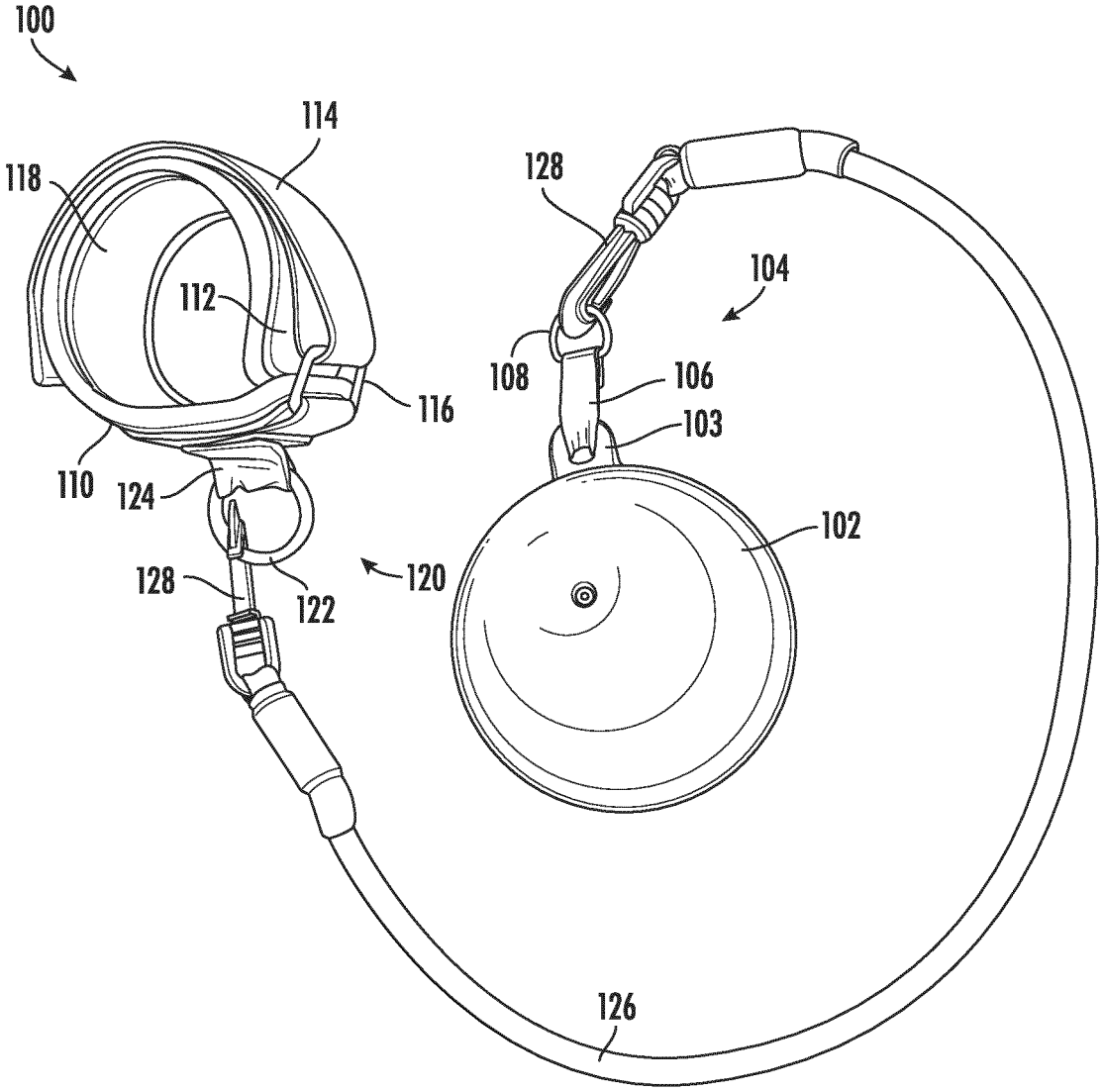
FIG. 1B is an alternative view of the exercise device of FIG. 1A, according to an exemplary embodiment.

Referring now to FIGS. 1A and 1B, illustrations of an exercise device 100 are shown, according to some embodiments. Exercise device 100 is shown to include a ball 102 and a securing member, shown as strap 110. Both ball 102 and strap 110 are coupled to a tension member 126, as shown in the exemplary embodiment of FIGS. 1A and 1B. Tension member 126 includes a pair of coupling mechanisms, shown as a pair of clasps 128, with one of the pair of clasps 128 configured to couple with a first connector 104 of ball 102 and the remaining of the pair of clasps 128 configured to couple with a second connector 120 of strap 110.

Ball 102 includes both an outer portion configured for the user to hold, as well as an inner weighted portion. Said outer portion of ball 102 may include a surface configured for a user to easily grip with one or both hands or otherwise secure when performing exercises. For example, the surface of the outer portion may be formed of silicone with a soft touch. Additionally, in some embodiments, the surface of the outer portion of ball 102 may include a texture configured to aid a user in gripping ball 102. The outer portion of ball 102 may also be substantially rigid such that ball 102 is not pliable or minimally pliable. The inner weighted portion of ball 102 may include one or more steel weights, weighted sand, or other weighted structure so as to add weight within ball 102.

In various embodiments of exercise device 100, the weight of ball 102 may vary. For example, in some embodiments, ball 102 may have a weight of 1.5 pounds, while in other embodiments, ball 102 may have a greater or lesser weight so as to accommodate a range of exercise abilities, exercise regimens, and preferred exercises of various users. Similarly, ball 102 may vary in size in order to, e.g., accommodate similar functions. For example, ball 102 may have a diameter of three inches, with said diameter being increased or decreased in alternative embodiments. As an illustration, ball 102 may be larger in some embodiments to facilitate certain exercises, to accommodate various hand sizes of users, or to accommodate weighted components within ball 102 to promote various exercises and training of certain muscle groups. However, it should be understood that ball 102 may have a different configuration in some embodiments. As an example, some embodiments of ball 102 may include an inflatable portion configured to provide structure to ball 102 with a port for inflation disposed on an outer surface of ball 102.

Ball 102 includes first connector 104, which is coupled to and extends from ball 102. In some embodiments, an outer surface of ball 102 may include a structure (i.e. a looped protrusion, a recess with a support and/or securing member, etc.), shown as looped structure 103 in FIGS. 1A and 1B, configured to accommodate coupling from first connector 104 to ball 102. First connector 104 is shown to include a first band 106 directly coupled to an outer portion of ball 102. First band 106 may be made of a nylon material or other flexible material and may be stitched, glued, or otherwise secured to ball 102. For example, as shown in the embodiment of FIGS. 1A and 1B, first band 106 is threaded through looped structure 103 and attached to itself to connect first connector 104 to ball 102.

First connector 104 is further shown to include a first ring 108, with the other end of first ring 108 (i.e., the end not coupled to ball 102) coupled to first band 106. Similar to the coupling between ball 102 and first band 106, coupling between first ring 108 and first band 106 may be by stitching, glue, or other securing mechanism. As an example, as shown in the embodiment of FIGS. 1A and 1B, first band 106 is also threaded through the center of first ring 108 and attached to itself to connect looped structure 103 to first ring 108. First ring 108 may be made of a metal or other rigid material, such as various plastics. First ring 108 is configured to be releasably coupled with one of the pair of clasps 128 of tension member 126. In some embodiments, first connector 104, including its component parts first band 106 and first ring 108, may be sized to as to accommodate releasable coupling with one of the pair of clasps 128, and vice versa.

Strap 110 may be formed of a nylon or other pliable material and is shown to include an outer surface 112 as well as an inner surface 118. Inner surface 118 is configured opposite from outer surface 112 on strap 110 and is configured to interface with the lower leg of a user. As shown in the exemplary embodiment of FIGS. 1A and 1B, inner surface 118 of strap 110 may include padding, with said padding occupying a portion or the entirety of inner surface 118 and configured to interface with a surface of a user's leg, thus providing comfort to the user when performing various exercises. Additionally, inner surface 118 may include one or more structures or materials configured to secure strap 110 to a leg of a user, such as a textured structure or material (e.g., textured with a grip print).

Outer surface 112 is configured to secure strap 110 to a leg of a user via a fastener 114 provided on outer surface 112 (e.g., with a portion of fastener 114 stitched all around the outside of strap 110 to form all or a portion of outer surface 112, as shown in FIGS. 1A and 1B). In some embodiments, fastener 114 may include multiple segments, with the segments configured to interface with one another so as to secure strap 110 to a user's leg. For example, fastener 114 may include a loose end not secured to outer surface 112 including a segment with hook fasteners and a segment with loop fasteners that is secured (e.g., by stitching) to outer surface 112. Accordingly, the user can put a portion of their limb, such as an ankle or calf, inside strap 110 and secure strap 110 to the limb portion by attaching the hook segment of fastener 114 to the loop segment. Strap 110 is further shown to include a buckle 116. Buckle 116 is coupled to an end of fastener 114 (e.g., by fastener 114 being threaded through buckle 116 and attached to itself, such as by stitching) such that buckle 116 protrudes from strap 110 and receives an opposite end of fastener 114. As shown in FIGS. 1A and 1B, buckle 116 receives a portion of fastener 114, such as a loose end of fastener 114, through buckle 116 so as to facilitate securing of strap 110 about a user's leg via fastener 114. Additionally, buckle 116 may be used to provide adjustable functionality to strap 110. Referring back to the previous example, when the user secures strap 110 to their limb portion within strap 110, the user can pull fastener 114 such that fastener 114 is threaded through buckle 116 until strap 110 is sized for the limb portion. The user can then attach the hook segment to the loop segment of fastener 114 to fix strap 110 in place and therapy secure strap 110 to the limb portion.

Strap 110 is further shown to include a second connector 120, with second connector 120 coupled to outer surface 112 of strap 110. Second connector 120 is shown to include second band 124 and second ring 122. Second band 124 is coupled to outer surface 112 of strap 110 such that it protrudes therefrom. Second band 124 may be made of a nylon material or other flexible material and may be coupled to strap 110 via stitching, glue, or another attachment mechanism. For example, as shown in the embodiment of FIGS. 1A and 1B, second band 124 is stitched onto fastener 114 forming a portion of outer surface 112. Second ring 122 is indirectly coupled to outer surface 112 of strap 110 via second band 124. For example, as shown in the exemplary embodiment of FIGS. 1A and 1B, second ring 122 is coupled to second band 124 by second band 124 being threaded through the center of second ring 122 and attached to itself and to outer surface 112 (e.g., via stitching). Additionally, second ring 122 may be made of a plastic, a metal, or another rigid or substantially rigid material. Second connector 120 and its component parts are configured to be releasably coupled with one or more clasps 128 of tension member 126. It should be noted that, in some embodiments, first connector 104 and second connector 120 may have similar structures. It should also be noted that, in some embodiments, components of first connector 104 as shown and disclosed above may additionally be implemented as components of second connector 120, and vice versa.

Tension member 126 includes a pair of clasps 128, with each clasp 128 disposed at opposite ends of tension member 126. Example configurations for clasps 128 include carabiner clips, lobster claw clips, snap hook clips, and so on. A portion of each clasp 128 is secured to each end of tension member 126. For example, as shown in the embodiment of FIGS. 1A and 1B, each clasp 128 may include a ring portion. The ends of tension member 126 may be looped through the ring portions of clasps 128 and secured to tension member 126, such as with a band encircling the looped ends, to couple tension member 126 to clasps 128. However, it should be understood that clasps 128 may be secured to tension member 126 through another mechanism or structure (e.g., gluing, buckling, etc.). As noted above, clasps 128 also releasably attach to first connector 104 and second connector 120. As an example, as shown in the embodiment of FIGS. 1A and 1B, each clasp 128 includes a snap hook portion that can looped and unlooped around first ring 108 or second ring 122. In other embodiments, clasps 128 may include different structures for releasable coupling, such as spring levers the user can press down to open a portion of clasps 128 for coupling and uncoupling to first ring 108 and second ring 122. Additionally, in some embodiments, pair of clasps 128 (and, if needed to facilitate coupling, one or more components of first connector 104 and second connector 120) may be replaced with alternative structures for releasable coupling with first connector 104 and second connector 120, such as buckles or other mating components.

Pair of clasps 128 are configured to rotate independent of a body of tension member 126. As an illustration, pair of clasps 128 may remain in a fixed position while tension member 126 rotates about its central axis, or pair of clasps 128 may rotate about their respective central axes while the body of tension member 126 remains fixed. Such movement capability is conducive to a user performing exercises with exercise device 100 that may include swiveling, twisting, turning, or otherwise pivoting without tension member 126 becoming twisted or tangled. To facilitate this independent rotation, each clasp 128 may include portions (e.g., a ring portion connecting to tension member 126 and a snap hook portion connecting to first connector 104 or second connector 120) that interlock together, such as through a pin connecting the portions, to allow swiveling of the clasp 128. Additionally, it should be understood that while tension member 126 is shown to include clasps 128 in FIGS. 1A and 1B, other embodiments of tension member 126 may include other coupling mechanisms.

Tension member 126 is configured to stretch in response to applied tensile forces. For example, if a user has secured strap 110 to the user's leg and grasps ball 102, movement of strap 110, the lower leg of the user, and/or ball 102 applies a tensile force to tension member 126, thereby creating resistance and allowing the user to perform resisted exercises. In some embodiments, alternative tension members may be implemented so as to provide resistance under similar circumstances but to accommodate various user preferences. For example, a user may desire a longer or shorter tension member, e.g., that may be more suited to various exercises or height ranges of the user or may provide increased or decreased resistance. As such, exercise device 100 may be interchangeably used with tension members 126 of different lengths or different resistances.

Additionally or alternatively, in some embodiments, tension member 126 may be configured to couple with one or more tension member extensions. The tension member extension(s) allow for tension member 126 to be extended (e.g., by 2 inches, by 2.5 inches) so as to modify exercise device 100 to accommodate different users or exercises or apply a different resistance. As an illustration, a tension member extension may couple between tension member 126 and ball 102 or strap 110. For example, the tension member extension may include one or more components similar to the components of first connector 104, second connector 120, and/or clasps 128 such that the tension member extension may connect to first connector 102 and/or second connector 120 and one of clasps 128. Further, in some embodiments, tension member 126 may be configured to shorten and/or extend (e.g., tension member 126 itself may be extendible).

Figure 2:
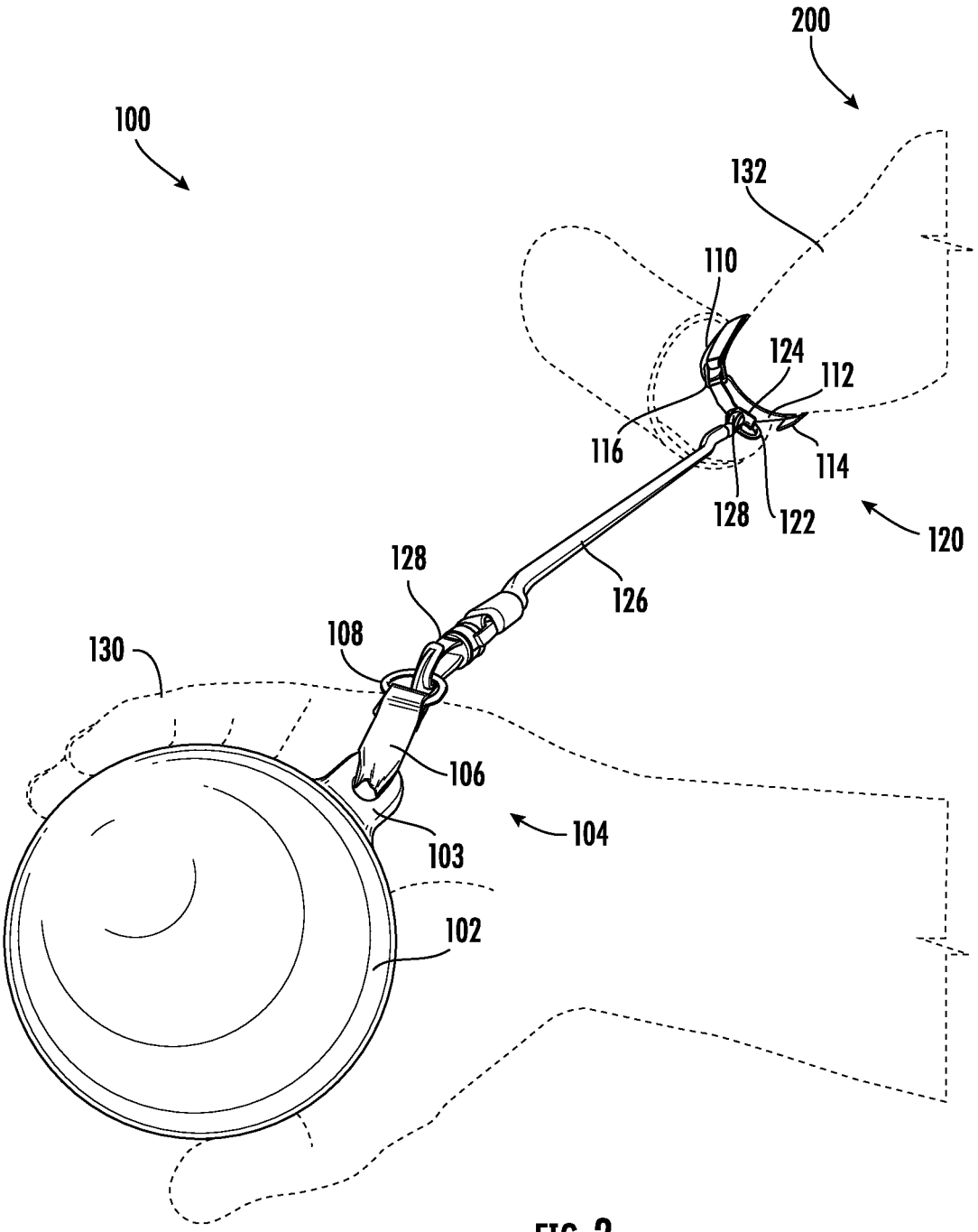
FIG. 2 is an illustration of the exercise device of FIG. 1B secured to a user, according to an exemplary embodiment.

Referring now to FIG. 2, an illustration of exercise device 100 coupled to a user 200 is shown, according to an exemplary embodiment. Strap 110 is shown to have been secured by user 200 to a lower leg 132. Ball 102 is shown to be grasped by a hand 130 of user 200, with tension member 126 coupled between ball 102 and strap 110. In some instances, user 200 may desire to secure strap 110 around particular portions of lower leg 132, e.g., if user 200 is rehabilitating an injury and must avoid a wound. As such, strap 110 may be loosened and/or tightened, moved to narrower or broader portions of lower leg 132, and secured to the narrower or broader portions of lower leg 132. The configuration of exercise device 100 shown in FIG. 2 allows for tension member 126 to provide resistance through movement of lower leg 132 (and therefore strap 110) and/or hand 130 (and therefore ball 102), as discussed further below. As shown in FIG. 2, strap 110 is secured to a left leg of user 200 and ball 102 is held in a left hand of user 200. In some embodiment, ball 102 may also be held in a right hand of user 200, and strap 110 may be configured to pivot about lower leg 132 such that tension member 126 extends from the medial side of lower leg 132 toward said right hand of user 200. Or, if so desired, strap 110 may be secured to lower leg 132 in such a manner that tension member 126 remains extending from a lateral portion of lower leg 132 despite user 200 transferring ball 102 to said right hand. Additionally, it should be understood that strap 110 may alternatively be secured to a right leg of user 200, with ball 102 held in the right hand of user 200 (e.g., in a mirror of the configuration shown in FIG. 2) or held in the left hand of user 200.

User 200 is shown to grasp ball 102 in hand 130 as shown in FIG. 2, with ball 102 positioned such that first connector 104 extends from ball 102 in the direction of lower leg 132. Tension member 126 is shown to be coupled to both ball 102 in hand 130 of user 200 and strap 110 secured to lower leg 132 via second connector 120. If leg 132 and strap 110 are kept stationary, movement of ball 102 by user 200 in a direction substantially opposite lower leg 132 (e.g., in a direction that extends tension member 126) will apply a tensile force to tension member 126, thus providing resistance for user 200 to perform one or more exercises. In the instance that user 200 moves lower leg 132 in a direction substantially opposite hand 130 and ball 102 as shown, a tensile force will be similarly applied also allowing for tension member 126 to provide resistance.

Figure 3A:
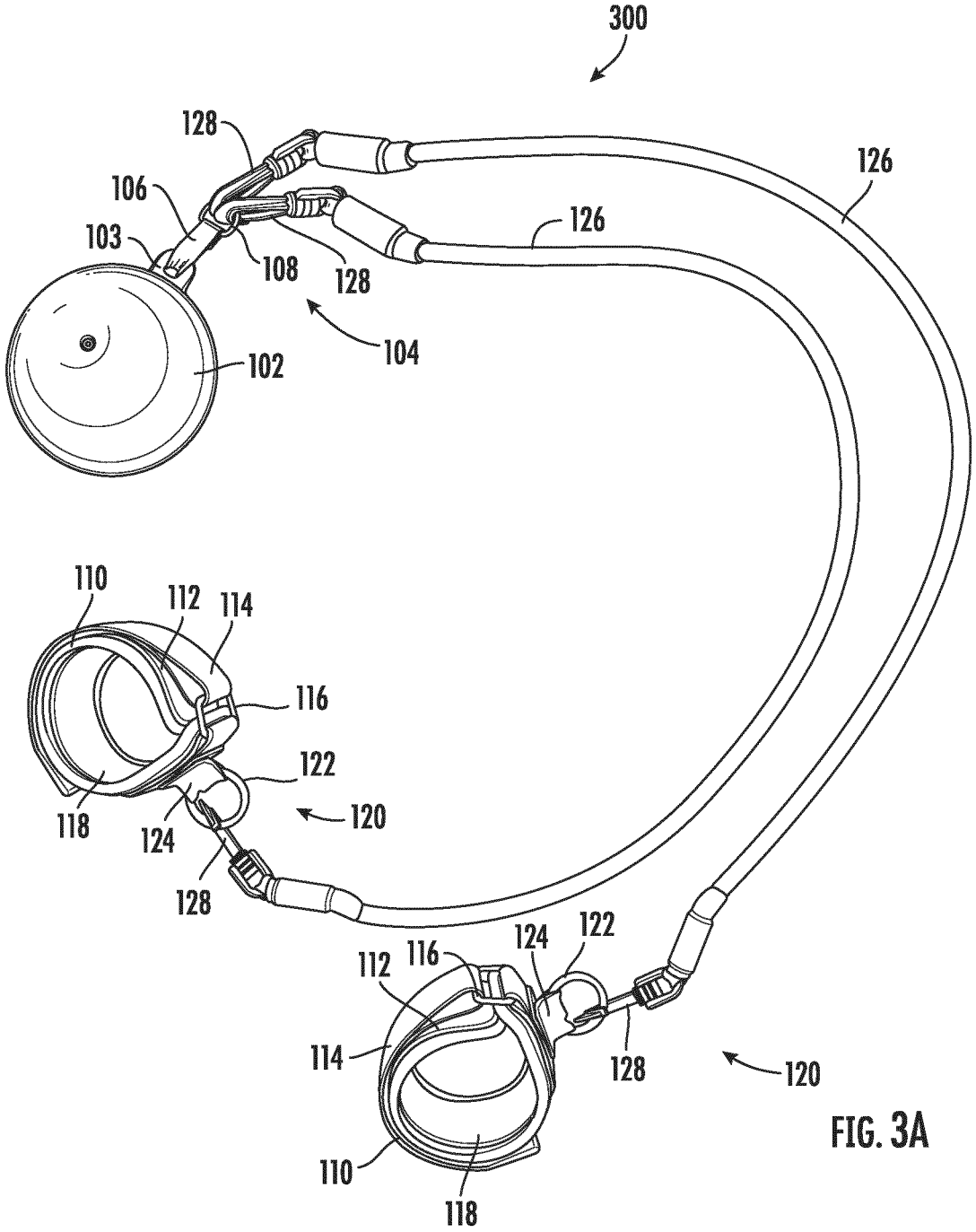
FIG. 3A is an illustration of an alternative embodiment of an exercise device, according to an exemplary embodiment.

Referring now to FIG. 3A, an illustration of an alternative embodiment of an exercise device 300 is shown, according to an exemplary embodiment. Exercise device 300 may be similar to exercise device 100 as shown in FIGS. 1A-2 and may also include multiple components the same as and/or similar to those of exercise device 100. For example, exercise device 300 is shown to include two tension members 126 and two straps 110, as well as the respective components thereof. Each tension member 126 is coupled to a strap 110 via a second connector 120 and to ball 102 via first connector 104.

Exercise device 300 may have various uses. As one use, in performing some exercises, it may be desirable to transition from one exercise to the next without taking the time to adjust tension member 126 and/or strap 110 as may be required of exercise device 100 should a user wish to exercise both legs in an alternating fashion. As such, exercise device 300 may allow said user to secure one of the straps 110 to each lower leg, with one of the tension members 126 coupled to each strap 110, and releasably couple ball 102 to tension members 126 in an alternating fashion as said user exercises body parts in a similar alternating fashion. For example, the user may couple a tension member 126 secured to a left leg of the user via a strap 110 to ball 102 to perform exercises relating to the left leg, uncouple this tension member 126 once those exercises are completed, and couple a tension member 126 secured to a right leg of the user via a strap 110 to ball 102 to perform exercises relating to the right leg. Additionally, in performing some exercises said user may desire additional resistance, for which both tension members 126 of exercise device 300 may be coupled to ball 102 and a single strap 110, thus allowing the user to apply additional resistance by the two tension members 126 relative to use of a single tension member 126. As another use, a user may secure both straps 110 to the user's lower legs and couple tension members 126 to straps 110 and to ball 102 simultaneously (e.g., as shown in FIG. 2) and use exercise device 300 in this configuration to perform exercises providing resistance to ball 102 via both legs. Alternatively, in some embodiments, FIG. 3 illustrates a shipping configuration for exercise device 300 such that both straps 110 are releasably coupled to ball 102 to avoid separation and potential loss of the components of exercise device 300 during packaging and shipping.

In some embodiments, exercise device 300 may be provided to a user as an alternate embodiment of exercise device 100 with additional, alternative, and/or replacement components. For example, in some embodiments, tension members 126 of exercise device 300 as shown in FIG. 3 may be of different grades (e.g., tension members 126 may include a different geometry or different geometries and/or length(s) and may therefore provide different ranges of resistance for a user relative to exercise device 100). Similarly, in some embodiments, straps 110 of FIG. 3 may be of different sizes and/or geometries so as to accommodate different body parts of a user (e.g., calf, ankle, etc.) and/or may include differently configured straps, such as weighted straps to provide additional resistance for exercises performed by a user.

Alternatively, in some embodiments, an exercise device may include additional or fewer components than the embodiments described above. For example, an exercise device may include ball 102, one tension member 126, and two straps 110 (e.g., one for each lower leg of the user). The user may utilize this exercise device with one strap 110 or wear both straps 110 and switch tension member 126 between straps 110 to exercise different muscles and muscle groups (e.g., to exercise each of the user's lower legs).

Figure 3B:
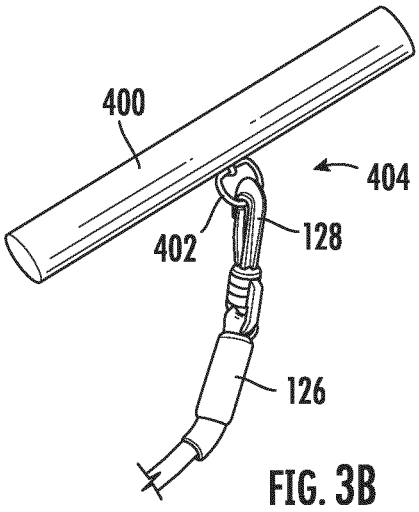
FIG. 3B is an illustration of an alternative hand piece of an exercise device, according to an exemplary embodiment.
Figure 3C:
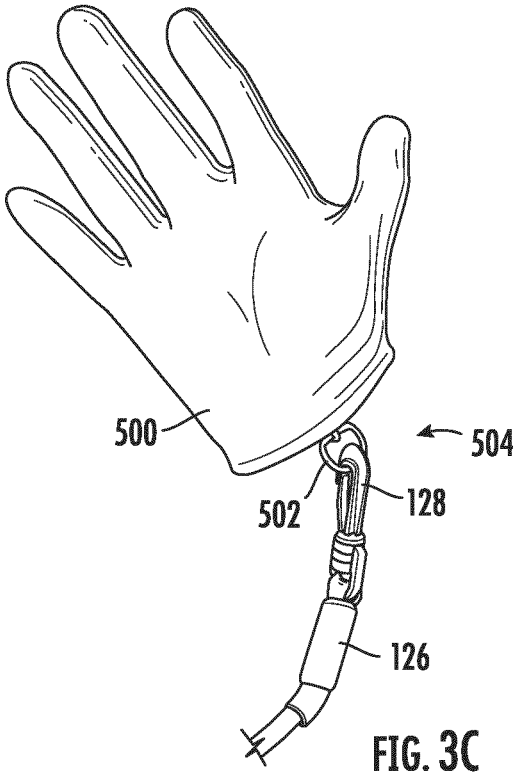
FIG. 3C is an illustration of an alternative hand piece of an exercise device, according to an exemplary embodiment.
Figure 3D:
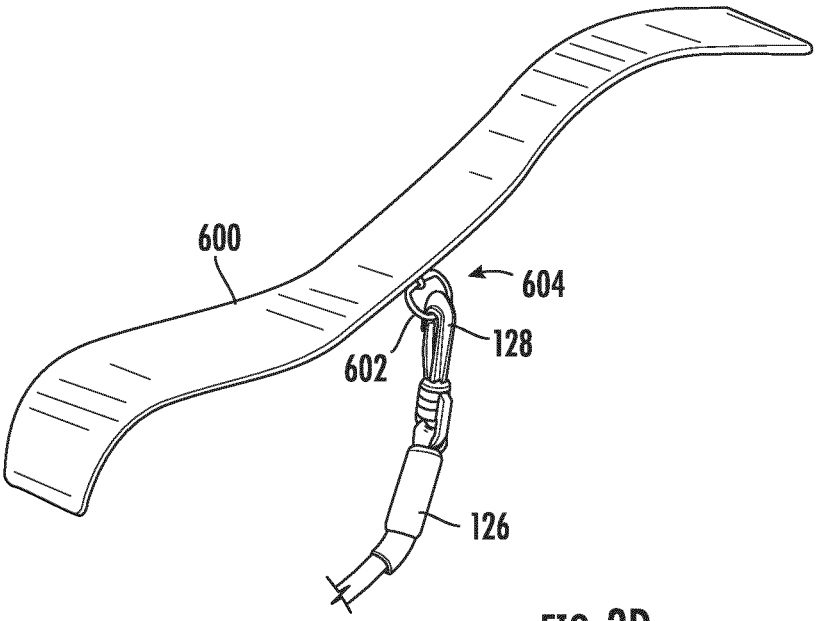
FIG. 3D is an illustration of an alternative hand piece of an exercise device, according to an exemplary embodiment.

In some embodiments, an exercise device may include a different hand piece than the ball 102. Referring now to FIGS. 3B-3D, alternative hand pieces for an exercise device (e.g., exercise device 100 or exercise device 300) are shown, according to exemplary embodiments. FIG. 3B illustrates a handle 400 coupled to the tension member 126. Specifically, the handle 400 is connected to the tension member 126 via a third connector 404 that includes a third ring 402 onto which the clasp 128 of the tension member 126 is releasably coupled. The third ring 402 may be a metal ring, a plastic ring, or another type of ring suitable for coupling to the clasp 128, and the third ring 402 may be connected to the handle 400 through any suitable mechanism (e.g., screwed into handle 400). A user may use an exercise device including the handle 400 by strapping the strap (e.g., strap 110) of the exercise device on a lower leg of the user and holding the handle 400 while performing exercises. In some arrangements, the handle 400 may be weighted (e.g., through a weight provided in the interior of the handle 400, such as a weighted core or sand) to provide weighted resistance to exercises.

FIG. 3C illustrates a glove 500 coupled to the tension member 126. Similar to the handle 400, the glove 500 is connected to the tension member 126 via a fourth connector 504 that includes a fourth ring 502 onto which the clasp 128 of the tension member 126 is releasably coupled. The fourth ring 502 may be a metal ring, a plastic ring, a fabric ring, or another type of ring suitable for coupling to the clasp 128. The fourth ring 502 may be, e.g., sewn onto the glove 500 or glued onto the glove 500. As such, in some arrangements, the fourth connector 504 may include a band that connects the fourth ring 502 to the glove 500, similar to the first band 106. A user may use an exercise device including the glove 500 by strapping the strap (e.g., strap 110) of the exercise device onto the lower leg of the user, pulling the glove 500 on a hand of the user, and performing exercises with the lower leg and/or the hand. In some arrangements, the glove 500 may be weighted (e.g., through one or more weights sewn on or into the glove 500) to provide weighted resistance to exercises.

FIG. 3D illustrates a wrist wrap 600 coupled to the tension member 126. Similar to the handle 400 and the glove 500, the wrist wrap 600 is connected to the tension member 126 via a fifth connector 604 that includes a fifth ring 602 onto which the clasp 128 of the tension member is releasably coupled. Similar to the fourth ring 502, the fifth ring 602 may be a metal ring, a plastic ring, a fabric ring, or another type of ring suitable for coupling to the clasp 128. The fifth ring 602 may be, e.g., sewn onto the wrist wrap 600 or glued onto the wrist wrap 600, and in some arrangements, the fifth connector 604 may include a band that connects the first ring 602 to the wrist wrap 600, similar to the first band 106. A user may use an exercise device including the wrist wrap 600 by strapping the strap (e.g., strap 110) of the exercise device onto the lower leg of the user, wrapping the wrist wrap 600 around a hand and/or wrist of the user, and performing exercises with the lower leg and/or the hand. In some arrangements, the wrist wrap 600 may be weighted (e.g., through one or more weights sewn on or into the wrist wrap 600) to provide weighted resistance to exercises.

The exercise device may additionally or alternatively include a different strap than the strap 110 shown in FIGS. 1A-2. For example, in some embodiments, the exercise device may include a strap that can be put on the user, such as a sock. The sock may include, e.g., a ring or hook that the clasp 128 of the tension member 126 may releasably hook onto in order to connect the tension member 126 to the sock (e.g., similar to one of the connectors described above). Alternatively, the sock may be included as part of the strap 110 (e.g., the exercise device may include the strap 110, with the strap 110 sewn to the sock).

Figure 4A:
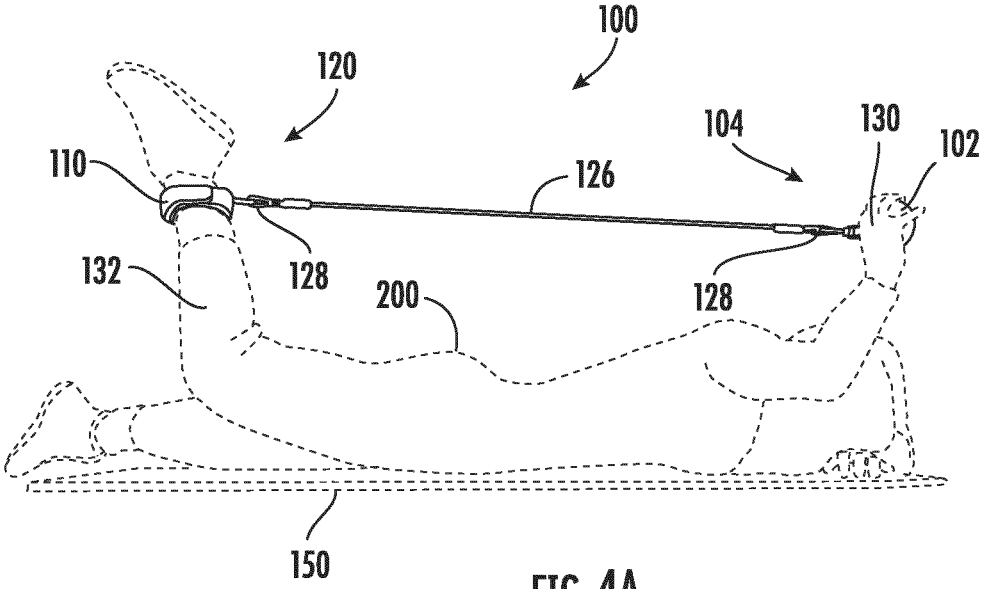
FIG. 4A is an illustration of a user performing an exercise using an exercise device, according to an exemplary embodiment.
Figure 4B:
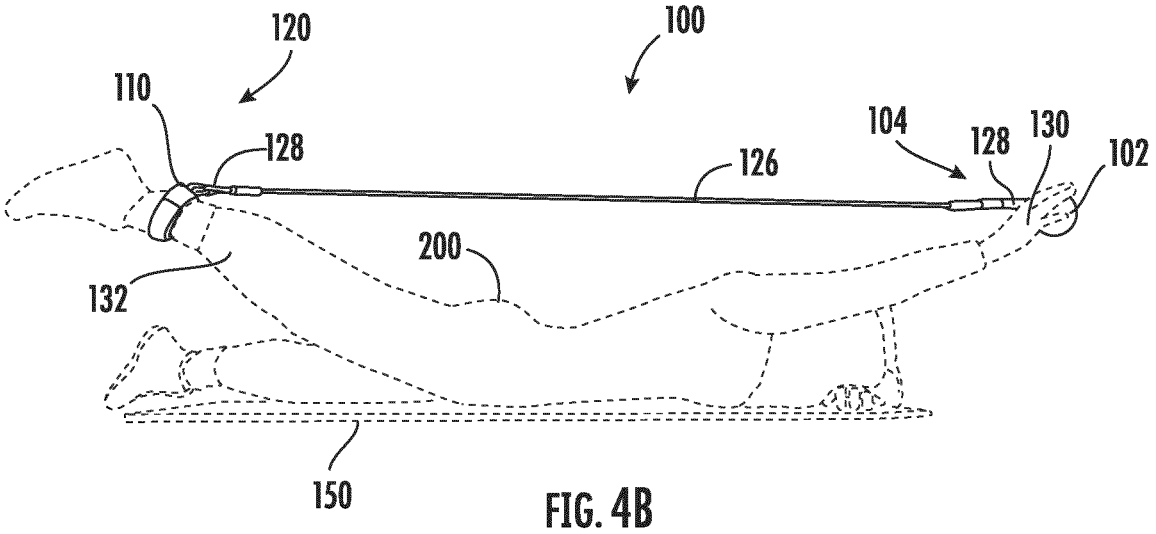
FIG. 4B is an alternative illustration of a user performing an exercise using an exercise device, according to an exemplary embodiment.

Referring now to FIGS. 4A and 4B, an illustration of a user performing an exercise using exercise device 100 is shown, according to an exemplary embodiment. User 200 is shown to be in a prone position on a surface 150. In said position, user 200 is face down on surface 150, with surface 150 including a floor or an exercise mat, for example. It should be noted that the position of user 200 in FIG. 4A may be modified in order to accommodate a specific user or surface 150. For example, in some embodiments, exercise device 100 may be used by a user 200 in a prone position in conjunction with other equipment, e.g., a pillow or similar between user 200 and surface 150 to provide support for the back or head of user 200 or to modify the exercise depending on the capabilities of user 200.

FIG. 4A illustrates user 200 with strap 110 of exercise device 100 secured to lower leg 132 and ball 102 held in hand 130 while maintaining the prone position described previously. The position of FIG. 4A shows user 200 with lower leg 132 bent at the knee (while maintaining said prone position) such that strap 110 coupled to lower leg 132 is positioned substantially above the knee at which lower leg 132 is bent. FIG. 4A further shows user 200 maintaining ball 102 in hand 130, with hand 130 raised above the head of the user. As such, second connector 120 extends from strap 110 toward the upper body of user 200 when in the position of FIG. 4A, and first connector 104 extends from strap 110 toward the lower body of user 200. Such orientation of exercise device 100 allows for tension member 126, which is shown to be releasably coupled to strap 110 and ball 102, to stretch and contract without interference or contact from other components of exercise device 100 or other portions of the anatomy of user 200. Said orientation also allows for user 200 to move from the position of FIG. 4A in which tension member 126 is in a contracted state (e.g., providing minimal resistance) to the position of FIG. 4B in which tension member 126 is in a stretched state (e.g., providing increased resistance).

Referring now to FIG. 4B, user 200 is shown in a prone position similar to that of FIG. 4A. However, the position of user 200 shown in FIG. 4B includes lower leg 132 extended at the knee such that strap 110 coupled to lower leg 132 is no longer substantially above the knee. Additionally, hand 130 is shown to hold ball 102 in hand 130 as in FIG. 4A, but with the arm of user 200 fully extended in a direction substantially opposite lower leg 132. Alternating movement between the positions of FIG. 4A and FIG. 4B results in repeated stretching and contraction of tension member 126 and therefore cycles of minimal to increased resistance to muscles of user 200. The exercise demonstrated by positions of user 200 shown in FIGS. 4A and 4B may target the triceps, gluteal, and quadriceps, as well as various back and core/abdominal muscles, among other muscles. It should be noted that, in order to target different or alternative muscle groups, or to accommodate users with decreased capabilities, the exercise of FIG. 4A and FIG. 4B may be modified.

Figure 5A:
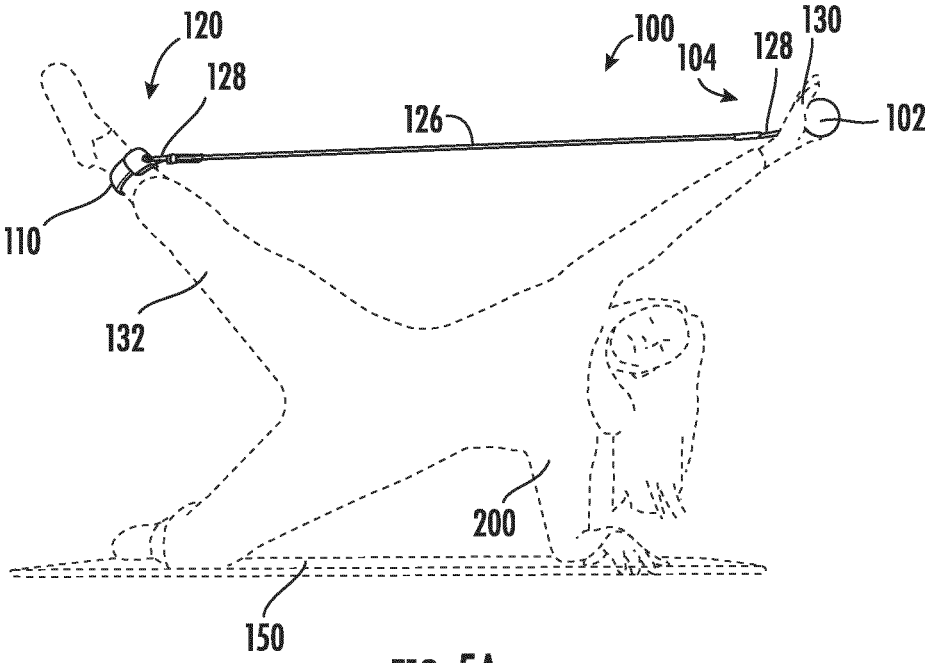
FIG. 5A is an illustration of a user performing another exercise using an exercise device, according to an exemplary embodiment.
Figure 5B:
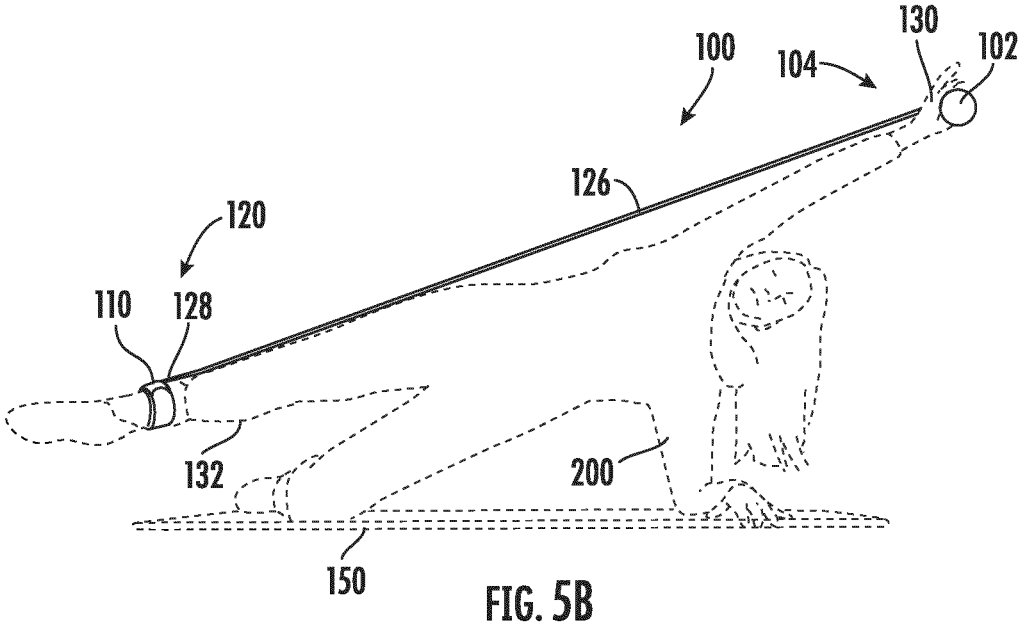
FIG. 5B is an alternative illustration of a user performing another exercise using an exercise device, according to an exemplary embodiment.

Referring now to FIGS. 5A and 5B, an illustration of a user performing an additional exercise using exercise device 100 is shown, according to an exemplary embodiment. FIGS. 5A and 5B show user 200 in a two-point support orientation, which is to say that user 200 is shown to maintain two primary points of contact with surface 150 (e.g., as shown in FIGS. 5A and 5B, the forearm and knee). While maintaining said two-point support, user 200 may alternate between positions of FIG. 5A and FIG. 5B in order to perform a strengthening/toning exercise. FIG. 5A illustrates the arm and leg not providing the two-point support (e.g., the right arm and leg in the example of FIG. 5A) extended above the centerline of user 200, with said extended limbs forming a substantially right angle with one another. Strap 110 of exercise device is shown to be coupled to lower leg 132 and positioned such that second connector 120 extends from strap 110 in the direction of the upper body of user 200, with lower leg 132 forming a portion of the aforementioned right angle. Ball 102 is shown to be held by hand 130 of user 200, with the arm including hand 130 and torso of user 200 forming an additional portion of said right angle. Ball 102 and strap 110 are both shown to be coupled to tension member 126, with tension member in a contracted state (e.g., providing minimal resistance).

In FIG. 5B, user 200 is shown to have maintained the two-point support while moving from the position of FIG. 5A such that lower leg 132 and hand 130 are extended in substantially opposite directions. For example, lower leg 132 is further extended towards surface 150 and/or the arm including hand 130 is further extended past the head of user 200. Such movement of lower leg 132 and/or hand 130 applies a tensile force stretching tension member 126, allowing user 200 to perform the movements shown in FIGS. 5A and 5B with resistance and thus strengthen/tone the targeted muscle groups. Movement between the positions shown in FIGS. 5A and 5B may be within the coronal plane of user 200 such that stretching and contraction of tension member 126 relative to movement of user 200 is supported by strap 110 and ball 102. Said strengthening/toning exercise shown in FIGS. 5A and 5B may target the obliques, quadriceps, hamstrings, biceps, and triceps of user 200, as well as other possible muscles/muscle groups. Additionally, the exercise shown in FIGS. 5A and 5B may be modified in order to strengthen/tone additional or alternative muscle groups or to accommodate users with decreased capabilities.

Figure 6A:
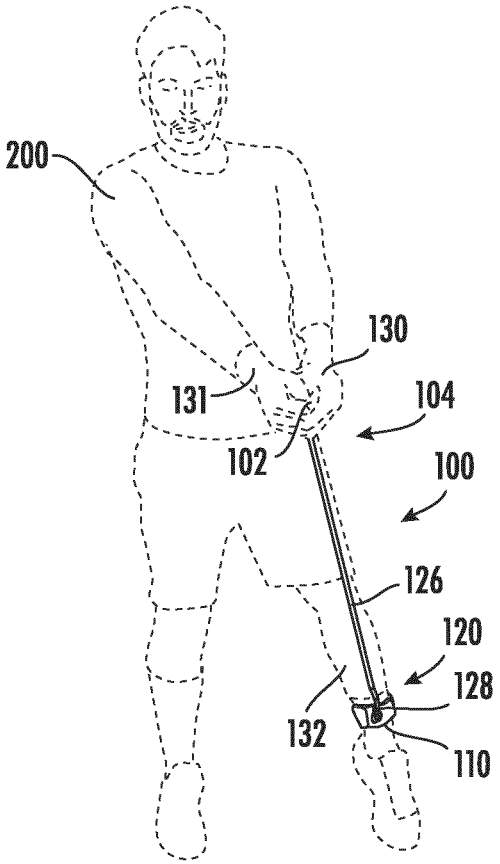
FIG. 6A is an illustration of a user performing another exercise using an exercise device, according to an exemplary embodiment.
Figure 6B:
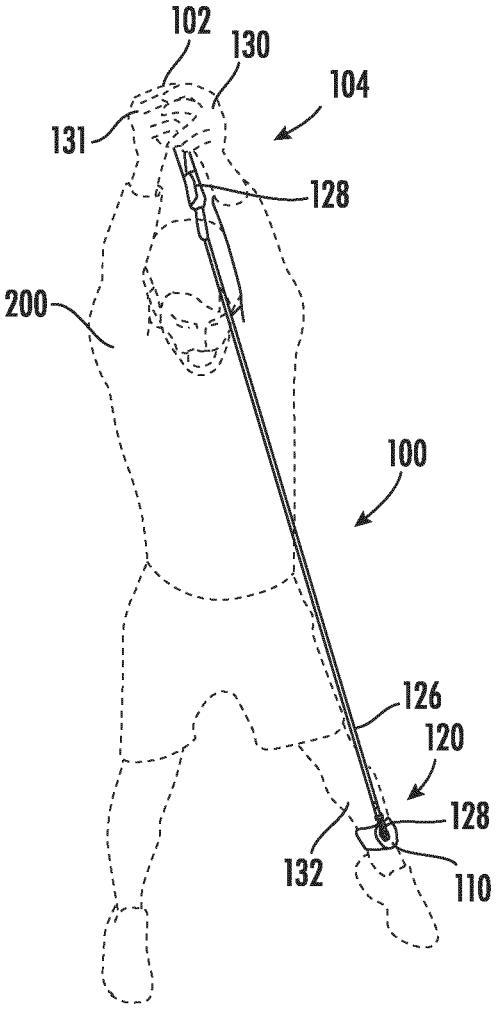
FIG. 6B is an alternative illustration of a user performing another exercise using an exercise device, according to an exemplary embodiment.

Referring now to FIGS. 6A and 6B, an illustration of a user performing an additional exercise using exercise device 100 is shown, according to an exemplary embodiment. User 200 is shown using exercise device 100 in a standing position in FIGS. 6A and 6B, with exercise device 100 secured similarly to the exemplary embodiments of FIGS. 4A and 4B and FIGS. 5A and 5B. Some exercises may be performed from a standing position as shown in FIGS. 6A and 6B, with said standing position allowing user 200 to target different muscles and/or muscle groups as well as apply different levels of resistance from various angles. For example, from a standing position such as that shown in the exemplary embodiment of FIGS. 6A and 6B, user 200 may target upper body muscles, including shoulders, as well as core muscles, including abdominals and obliques, in addition to various leg muscles, such as quadriceps, hamstrings, and calf muscles. Back muscles as well as abdominal and gluteal muscles may also be engaged by the exercises of FIGS. 6A and 6B.

User 200 is shown in FIG. 6A with feet spread approximately hip-width apart. Strap 110 is shown to be secured to lower leg 132 of user 200, with ball 102 grasped by hand 130 and a second hand 131. Second connector 120 is shown to be positioned on the anterior portion of lower leg 132, allowing for tension member 126 to be coupled to both strap 110 and ball 102 on an anterior side of user 200. The arms of user 200 are extended. Hand 130 and second hand 131 are positioned anterior relative to user 200 and are shown to grasp ball 102 at approximately waist height in the exemplary embodiment of FIG. 6A. In the exemplary embodiment of FIG. 6A, tension member 126 is in a contracted state (e.g., providing minimal resistance).

FIG. 6B illustrates an alternative position of the exercise shown in FIGS. 6A and 6B. User 200 is shown grasping ball 102 using hand 130 and second hand 131, with arms extended and hand 130 and second hand 131 positioned superior to the head of user 200. Strap 110 is shown to remain secured to lower leg 132 so as to provide support for tension member 126. Additionally, user 200 has stepped laterally with lower leg 132. Tension member 126 is in a stretched position due to the application of a tensile force by user 200. Lower leg 132 also contributes to the stretching of tension member 126 with the lateral step of lower leg 132 as ball 102 is raised superior to the head of user 200. Transition of tension member 126 from the contracted state of FIG. 6A to the stretched state of FIG. 6B is indicative of increased resistance provided by tension member 126 to user 200 in performing the exercise of FIGS. 6A and 6B.

The exercise shown in FIGS. 6A and 6B may be modified according to various factors. For example, ball 102 may be raised in various movement patterns, such as moving ball 102 laterally to the side of user 200 and back, so as to engage and subsequently strengthen/tone different muscles or muscle groups. Additionally, ball 102 may be raised by the user to different heights depending on the resistance desired by user from tension member 126. As an example, if user 200 were in the process of rehabilitating a shoulder injury, the range of motion (and therefore, the tension) of the exercise performed in FIGS. 6A and 6B may be limited. In some embodiments, user 200 may elect to perform an exercise in which ball 102 is grasped by only hand 130 or second hand 131 as the exercise of FIGS. 6A and 6B is performed (e.g., to provide more resistance to the single hand 130 or hand 131).

As noted above, the exercises shown in FIGS. 4A and 4B, FIGS. 5A and 5B, and FIGS. 6A and 6B may engage various muscles and muscle groups. Additionally, said exercises as shown may be modified for various purposes, such as to strengthen or tone said muscles and muscle groups. Modifications to exercises may also include securing strap 110 to opposite legs and holding ball 102 in opposite hands relative to the exercises shown. It should also be understood that the exercises shown in FIGS. 4A and 4B, FIGS. 5A and 5B, and FIGS. 6A and 6B are intended to be illustrative. Additionally, alternative exercises may be performed so as to target other muscles or muscle groups. For example, a user may perform standing crunches or squats while holding ball 102, may lay on their side while extending a lower leg with strap 110 secured and/or a hand holding ball 102, may lie on all fours while extending a lower leg with strap 110 secured and/or a hand holding ball 102, and so on. In some embodiments, the exercises shown may be performed using additional equipment, e.g., additional bands to supplement tension member 126 (or alternative versions thereof) or an additional strap 110 positioned on the other lower leg of user 200 so as to facilitate ease of adjusting from exercising muscle groups of one leg to the other.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. An exercise device comprising:

a strap comprising a first surface and a second surface opposite the first surface, the strap configured to be secured to a lower leg of a user such that the first surface of the strap interfaces with the lower leg of the user;

a ball comprising an outer surface configured to be held by the user, the outer surface including a rigid protrusion having an aperture;

a first connector coupled to the rigid protrusion of the ball via the aperture;

a second connector extending from the second surface of the strap; and a tension member comprising a first coupling mechanism and a second coupling mechanism at opposite ends thereof and configured to be releasably coupled to the first connector and the second connector via the first and second coupling mechanisms, respectively.

2. The exercise device of claim 1, wherein the second surface of the strap further comprises a fastener configured to secure the strap to the lower leg of the user.

3. The exercise device of claim 2, wherein the fastener comprises segments including hook and loop fasteners.

4. The exercise device of claim 2, wherein the fastener is configured to adjustably secure the strap to the lower leg of the user.

5. The exercise device of claim 1, wherein the first surface of the strap comprises padding.

6. The exercise device of claim 1, wherein the outer surface of the ball comprises silicone, and an inner portion of the ball comprises a steel weight.

7. The exercise device of claim 1, wherein the ball is configured to be held by at least one of a single hand of the user or both hands of the user, and wherein the ball is weighted so as to facilitate resisted exercise movements while the ball is held by the user.

8. The exercise device of claim 1, further comprising a tension member extension configured to releasably couple to the first coupling mechanism or the second coupling mechanism of the tension member and the first connector of the ball or the second connector of the strap.

9. The exercise device of claim 1, wherein the first coupling mechanism and the second coupling mechanism of the tension member are further configured to rotate independent of a body of the tension member.

10. The exercise device of claim 1, wherein the rigid protrusion extends from the outer surface of the ball in a direction substantially perpendicular to the outer surface of the ball.

11. An exercise device comprising:

an inflatable ball comprising an outer surface configured to be held by a user, the outer surface including a structure that is a rigid looped protrusion having an aperture;

a first connector coupled to the rigid looped protrusion of the ball;

a first strap configured to be secured to a lower left leg of the user, the first strap comprising:

a first surface configured to interface with the lower left leg of the user;

a second surface opposite the first surface; and a second connector extending from the second surface;

a second strap configured to be secured to a lower right leg of the user, the second strap comprising:

a third surface configured to interface with the lower right leg of the user;

a fourth surface opposite the third surface; and a third connector extending from the fourth surface;

a first tension member comprising a first coupling mechanism and a second coupling mechanism at opposite ends thereof; and a second tension member comprising a third coupling mechanism and a fourth coupling mechanism at opposite ends thereof;

wherein each of the first tension member and the second tension member is configured to be releasably coupled to the first connector of the ball and to at least one of the second connector of the first strap or the third connector of the second strap, via the first and second coupling mechanisms of the first tension member and the third and fourth coupling mechanisms of the second tension member, respectively, such that the exercise device is configured to be used with the ball coupled to at least one of the first tension member or the second tension member.

12. The exercise device of claim 11, wherein the second surface of the first strap comprises a first fastener configured to secure the first strap to the lower left leg of the user, and the fourth surface of the second strap comprises a second fastener configured to secure the second strap to the lower right leg of the user.

13. The exercise device of claim 12, wherein the first fastener and the second fastener each comprises segments including hook and loop fasteners.

14. The exercise device of claim 12, wherein the first fastener is configured to adjustably secure the first strap to the lower left leg of the user and the second fastener is configured to adjustably secure the second strap to the lower right leg of the user.

15. The exercise device of claim 11, wherein the first surface of the first strap and the third surface of the second strap each comprises padding.

16. The exercise device of claim 11, wherein the outer surface of the ball comprises silicone and rubber, and an inner portion of the ball comprises a steel weight.

17. The exercise device of claim 11, wherein the ball is configured to be held by at least one of a single hand of the user or both hands of the user, and wherein the ball is weighted so as to facilitate resisted exercise movements while the ball is held by the user.

18. The exercise device of claim 11, further comprising a tension member extension configured to releasably couple to at least one of the first tension member or the second tension member and at least one of the first connector of the ball, the second connector of the first strap, or the third connector of the second strap.

19. The exercise device of claim 11, wherein the first coupling mechanism and the second coupling mechanism of the first tension member are configured to rotate independent of a body of the first tension member, and wherein the third coupling mechanism and the fourth coupling mechanism of the second tension member are configured to rotate independent of a body of the second tension member.

20. An exercise device comprising:

a strap comprising a first surface and a second surface opposite the first surface, the strap configured to be secured to a lower leg of a user such that the first surface of the strap interfaces with the lower leg of the user;

a ball comprising an outer surface configured to be held by the user, the outer surface including a structure that is a rigid looped protrusion;

a first connector coupled to the rigid looped protrusion of the ball;

a second connector extending from the second surface of the strap;

a tension member comprising a first coupling mechanism and a second coupling mechanism at opposite ends thereof and configured to be releasably coupled to the first connector and the second connector via the first and second coupling mechanisms, respectively; and at least one tension member extension, each tension member extension configured to be releasably coupled between the tension member and at least one of the first connector or the second connector.

* * * * *